US007045040B2

(12) United States Patent
Basol

(10) Patent No.: US 7,045,040 B2
(45) Date of Patent: May 16, 2006

(54) PROCESS AND SYSTEM FOR ELIMINATING GAS BUBBLES DURING ELECTROCHEMICAL PROCESSING

(75) Inventor: Bulent M. Basol, Manhattan Beach, CA (US)

(73) Assignee: ASM Nutool, Inc., Fremont, CA (US)

( * ) Notice: Subject to any disclaimer, the term of this patent is extended or adjusted under 35 U.S.C. 154(b) by 248 days.

(21) Appl. No.: 10/692,952

(22) Filed: Oct. 24, 2003

(65) Prior Publication Data

US 2004/0182712 A1 Sep. 23, 2004

Related U.S. Application Data

(60) Provisional application No. 60/456,166, filed on Mar. 20, 2003.

(51) Int. Cl.
*C25D 21/00* (2006.01)

(52) U.S. Cl. ..... 204/198; 204/212; 204/237; 204/275.1; 204/DIG. 7; 205/98; 205/672

(58) Field of Classification Search ..... None
See application file for complete search history.

(56) References Cited

U.S. PATENT DOCUMENTS 5,327,921 A * 7/1994 Mokuo et al. ..... 134/182
6,136,163 A 10/2000 Cheung et al.
6,274,023 B1 8/2001 Kaufman et al.
6,274,024 B1 8/2001 Kaufman et al.
6,395,101 B1 5/2002 Scranton et al.
6,551,487 B1 4/2003 Reid et al.
6,582,578 B1 6/2003 Dordi et al.
2003/0106802 A1* 6/2003 Hagiwara et al. ..... 205/297

* cited by examiner

*Primary Examiner*—Roy King
*Assistant Examiner*—William T. Leader
(74) *Attorney, Agent, or Firm*—Knobbe Martens Olson & Bear LLP

(57) ABSTRACT

A method and system for preventing gas bubble formation on a selected region of a wafer surface as the surface is brought in contact with a process solution for an electrochemical process is provided. The present invention employs the process solution to prevent or remove gas bubbles from the wafer surface during or before the electrochemical processing of the wafer surface. Accordingly, during the process, the wafer surface is initially brought in proximity of the surface of the process solution. Next, a process solution flow is directed towards the selected region of the wafer surface for a predetermined time. In the following step, the selected region of the wafer surface is contacted with the process solution flow for the predetermined time to prevent bubble formation, and the wafer surface is immersed into the process solution for electrochemical processing.

10 Claims, 8 Drawing Sheets

PROCESS AND SYSTEM FOR ELIMINATING GAS BUBBLES DURING ELECTROCHEMICAL PROCESSING

RELATED APPLICATION

This application claims priority from Provisional Application Ser. No. 60/456,166 filed on Mar. 20, 2003 (NT-292 P) which is incorporated herein by reference.

FIELD

The present invention generally relates to semiconductor processing technologies and more particularly to a semiconductor wafer wet processing system to be used for deposition or removal of materials.

BACKGROUND

In the semiconductor industry, various processes can be used to deposit or remove materials on or from the surface of wafers. For example, electrochemical deposition (ECD) or electrochemical mechanical deposition (ECMD) processes can be used to deposit conductors, such as copper, on previously patterned wafer surfaces to fabricate device interconnect structures. Once the conductor is deposited on the wafer surface to fill various features such as trenches and vias, excess conductor, which is also called overburden layer, often needs to be removed. Chemical mechanical polishing (CMP) is commonly used for this material removal step. Another technique, electropolishing or electroetching, can also be used to remove excess materials from the surface of the wafers. Electrochemical (or electrochemical mechanical) deposition of materials on wafer surfaces or electrochemical (or electrochemical mechanical) removal of materials from the wafer surfaces are collectively called "electrochemical processing". Electrochemical processing techniques include, but are not limited to, electropolishing (or electroetching), electrochemical mechanical polishing (or electrochemical mechanical etching), electrochemical deposition and electrochemical mechanical deposition. All the above techniques utilize a process solution.

As generally exemplified in FIG. 1, an ECD system 10 contains a chamber 12 including an electrode 14. The electrode is used as an anode for the deposition processes. However, the electrode may also be polarized as a cathode, if an electroetching or electropolishing process is employed. A carrier head 16 having a rotatable shaft 18 holds a wafer 20 in a process solution 22, which is delivered to the chamber 12 through a solution inlet 24. The solution leaves the chamber 12 from an upper end 26 of the chamber in the direction of arrow A for recycling, re-furbishing or discarding. For example, for copper deposition, the wafer is usually a preprocessed wafer having features or cavities on the surface, which are typically coated with conductive layers such as barriers and seed layers. During electrochemical processing the wafer is lowered into the process solution 22 and preferably rotated while a potential difference is applied between the wafer 20 and the electrode 14. The potential difference is applied by a power supply, which is connected to the electrode and the conductive wafer surface using suitable electrical contacts (not shown).

One difficulty in such a process is that as the wafer is lowered into the process solution, gas bubbles 28 may be trapped under the wafer 20. If the process is a deposition process for copper interconnect fabrication, for example, such bubbles prevent copper from depositing onto the bubble-containing regions on the wafer surface, giving rise to un-plated or under-plated areas, which represent defects in the plated material. Such defects reduce the reliability of the interconnect structures. Similarly, in an electropolishing process, trapped bubbles retard material removal from the regions containing the bubbles, giving rise to non-uniformities and defects and cause reliability problems.

In the prior art, various techniques are used to eliminate bubbles trapped under the wafers during entry into process solutions. One such known method requires tilting the carrier head 16 as it enters the process solution to let the bubbles escape. However this approach requires expensive carrier head designs, which increase manufacturing cost.

Therefore, to this end, there is a need for alternative bubble elimination designs and processes, which can be employed during electrochemical processing of a workpiece such as a wafer.

SUMMARY

The present invention provides a method and system to prevent bubble build up under a semiconductor wafer during or before an electrochemical process using a process solution. During the bubble prevention step, a flow of the process solution is first contacted with the selected region of the wafer surface for a predetermined time. In one embodiment, the selected region includes central region of the wafer surface. The process solution flow directed towards the selected region of the surface prevents bubble build up or remove already existing bubbles at the selected region as the wafer surface is immersed into the process solution. An electrochemical process is applied onto bubble free wafer surface as the process solution flow directed to the selected region is stopped.

One aspect of the present invention includes a method for preventing gas bubble formation on a workpiece surface using a process solution as the surface is brought in contact with the process solution for an electrochemical process. In the method, the workpiece surface is first brought in proximity of surface of the process solution, and a process solution flow is directed towards central region of the workpiece surface for a predetermined time. Next, the central region of the workpiece surface is contacted with the process solution flow for the predetermined time to prevent bubble formation.

Another aspect of the present invention includes a system for avoiding formation of gas bubbles on a selected region of a surface of a workpiece in a process chamber as workpiece surface is brought in contact with the process solution for an electrochemical process using a process solution. In the system, the workpiece is held and moved by a workpiece carrier. A solution shaper having at least one high flow section to direct a process solution flow towards the selected region of the workpiece surface for a predetermined time. The solution shaper is adapted to move to bring the high flow section under the selected region of the workpiece surface. In one embodiment, the high flow section is a flow opening.

DESCRIPTION

The method and system of the present invention will be described for an electroplating process. It should be understood that the invention may also be applied to wet material removal methods such as electropolishing and chemical etching techniques.

The present invention provides a method and system to prevent bubble build up on a workpiece surface or remove existing bubbles from the workpiece surface during or before an electrochemical process. The removal process is performed by first contacting a selected surface region, which preferably comprises the central portion of the workpiece, with the process solution. A flow of the process solution is directed to the central region of the wafer for a predetermined time to prevent bubble formation on the central region of the surface. The solution flow towards the selected region of the surface may be produced by directing the solution towards this specific region of the surface of the workpiece at least for a predetermined time. In this respect, force of the solution flow directed onto the selected region prevents bubble build up or disperse already existing bubbles at this region.

The process may be carried out in a variety of ways. For example, the process may be performed by directing a flow of the process solution towards the selected area of the surface of the workpiece and contacting the selected region with the flow for a predetermined time as the workpiece surface is in proximity of the solution surface. The predetermined time may be 1 to 10 seconds. In another example, the process may be performed upon a surface of the wafer that is already immersed into the process solution.

In one embodiment, a solution surface shaper device may be used to force the process solution towards the preselected region of the surface of the workpiece. For simplification purposes, the solution surface shaper device will be referred to as solution shaper hereinafter. As will be described more fully below, the solution shaper directs a flow of the process solution toward the workpiece for a predetermined time by shaping the exit for the flow of the solution using a high flow section of the solution shaper.

Figure 1:
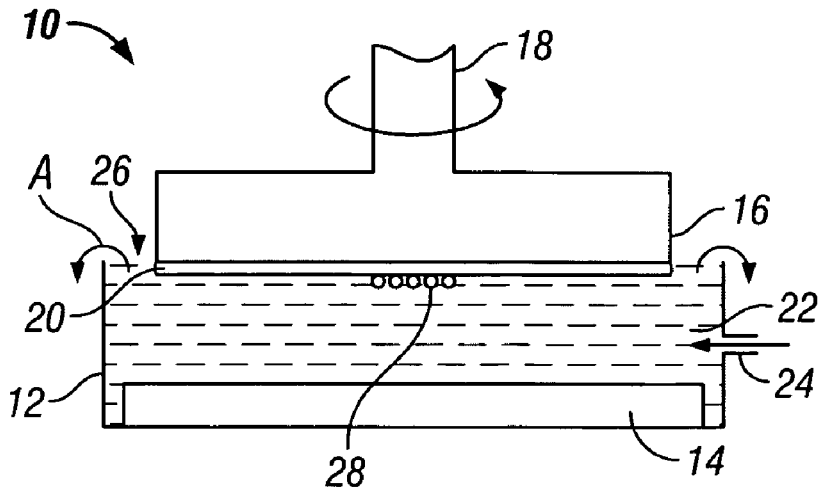
FIG. 1 illustrates an exemplary conventional electrochemical processing system having gas bubble trapping problem under a wafer during the electrochemical process.
Figure 2:
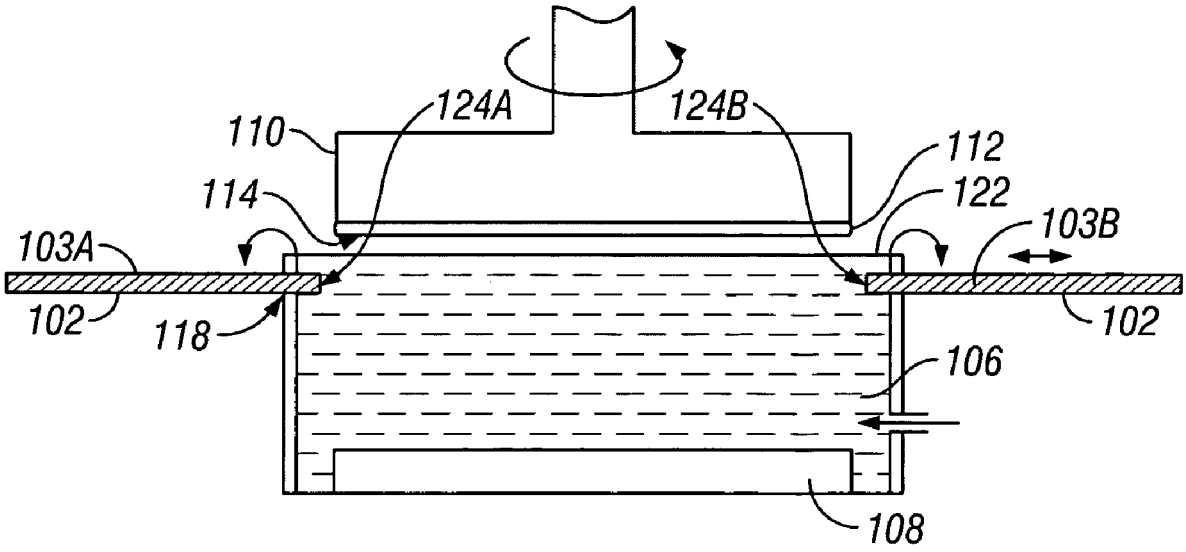
FIG. 2 illustrates an embodiment of a system employing a solution shaper of the present invention.

FIG. 2 illustrates an ECD system 100 of the present invention employing a solution shaper 102. In this embodiment the solution shaper may be made of a first shaping member 103A and a second shaping member 103B. The shaping members are substantially leveled with each. The system 100 includes a chamber 104 containing a process solution 106 and an electrode 108 immersed into the solution 106. Filters and other components, such as virtual anodes, current thieves, electric field shapers etc., which may be present in the ECD system 100 are not shown to simplify descriptions. A carrier head 110 holds a wafer 112 and exposes a surface 114 of the wafer 112 to the process solution 106. The carrier head 110 can be rotated and it may have the ability to move the wafer laterally as well as vertically (z-motion). The carrier head 110 can be rotated and laterally moved during the selected process steps. The process solution enters the chamber 104 through a solution inlet 116 and leaves the chamber for recycling from an upper end 118 of the chamber as depicted by arrow A. An exemplary process solution for electrodeposition may include copper sulfate based acidic solutions, which are available from companies such as Shipley. Further, an exemplary process solution for electropolishing may be a phosphoric acid based electropolishing solution. In FIG. 2, the surface shaper is shown in passive position and the wafer is above the solution surface 122. Before the electrochemical process or during the electrochemical process, the shaping members are moved towards each other to an active position using an appropriate moving mechanism.

Figure 3A:
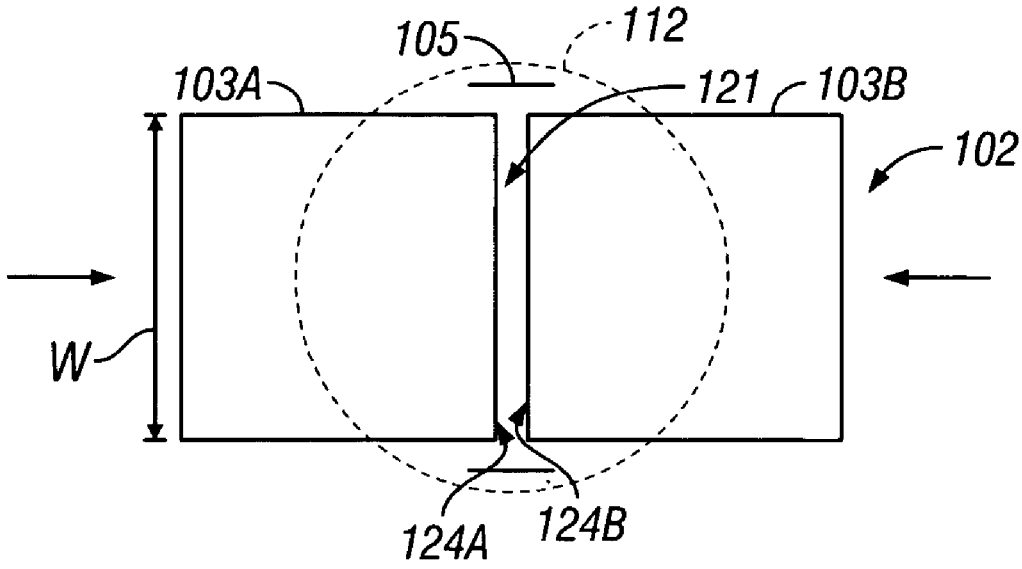
FIG. 3A illustrates a top view of the solution shaper shown in FIG. 2, wherein the solution shaper is in active position to remove gas bubbles from a central region of a wafer surface.
Figure 3B:
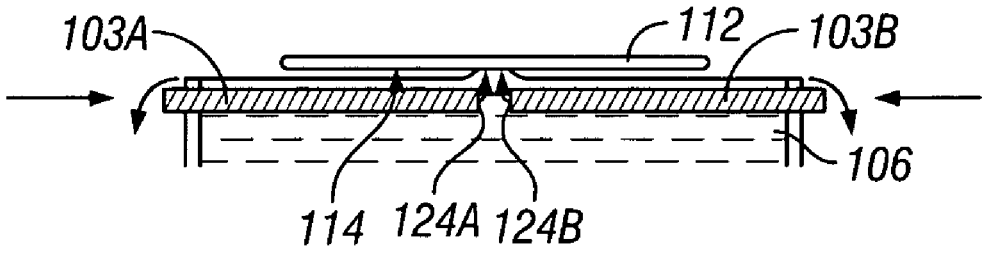
FIG. 3B illustrates a side view of the solution shaper shown in FIG. 3A during the gas bubble removal process.

FIGS. 3A and 3B show the surface shaper in top and side view when the first and second members of the solution shaper are moved into an active or operation position, forming a high flow section 121 between them. In this embodiment, the high flow section is for example a flow opening. The flow opening 121 may be a slit shaped gap, which is left between the shaping members. The flow opening 121 is preferably configured to be positioned along the diameter of the wafer 112 that is placed above the solution shaper 102. The flow opening 121 is just below the surface level 122 of the process solution 106. When the members meet under the center of the wafer, the hole 121 is aligned with the rotation axis of the wafer 112. The members 103A and 103B are configured to move in substantially the same plane either towards each other or away from each other. In this respect, the members may be rectangular plates. During the process, as the members 103A and 103B move toward each other, they limit the flow of the solution largely to the open area between them and cause a fountain-like upward solution flow between them. As the ends 124A and 124B of the members get closer to one another, the solution body under the surface shaper gets pressurized and hence the height of the upward solution flow is increased. It should be noted that FIG. 3A exemplifies a specific ECD system where dimension W is smaller than the diameter of the wafer and electrical contacts are made to the wafer surface at positions 105. More standard ECD systems where the cavity carrying the process solution is larger than the wafer diameter can also use the present invention.

Figure 4A:
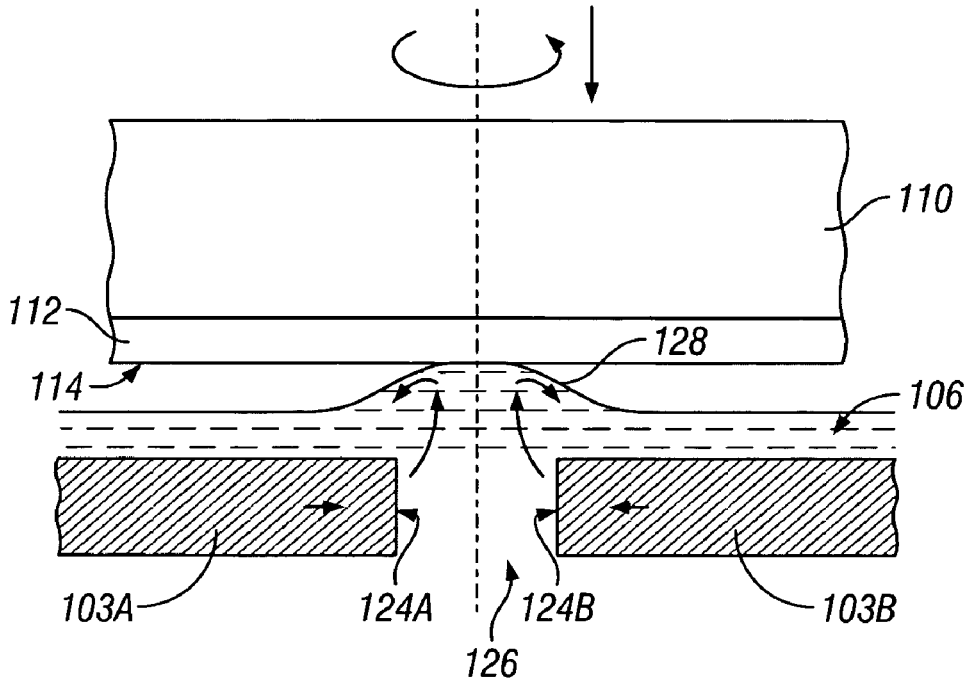
FIG. 4A illustrates a detailed cross sectional view of a flow opening of the solution shaper during the gas bubble removal process, wherein a flow of the process solution is directed towards the central region of the wafer surface.

As shown in FIG. 4A in detail, once the ends 124A and 124B form the flow opening 121 between them, the upward flow rate of the solution 106 cause the solution surface above the opening 121 to move up and form a raised surface 128 of the solution. In this embodiment, the flow opening preferably forms under the center of the wafer 112. At this point, if the surface of the wafer is close to the surface of the solution 106, the raised surface 128 contacts the wafer surface first and wets the center of the wafer. Before forming the raised surface 128, a preferred distance between the surface of the solution 106 and the surface of the wafer 112 may be in the range of 0.5 to 20 millimeters, preferably 0.5 to 10 millimeters.

During the process, downward vertical movement of the rotating wafer carrier and the lateral motion of the surface shaper may be coordinated so that when the raised solution surface forms, the wafer surface is lowered onto the solution. As the wafer continues its downward motion, first the center of the surface is wetted with high flow rate solution in the raised surface 128 and then the rest of the wafer is immersed into the process solution. This may happen in 1 to 10 seconds. This way bubbles cannot stay trapped at the center of the wafer. They are swept away.

Figure 4B:
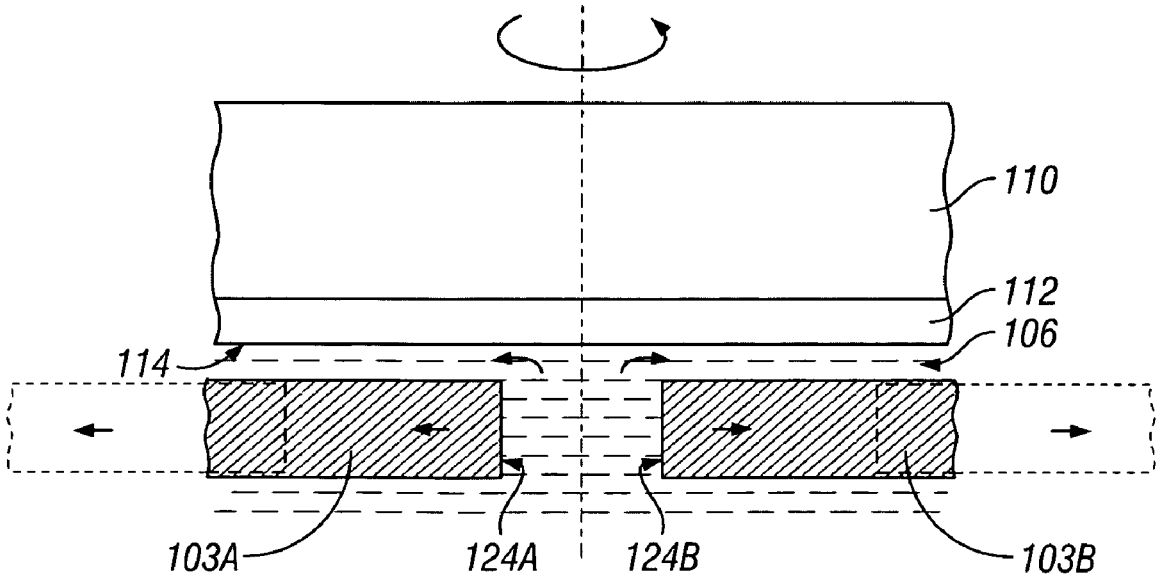
FIG. 4B illustrates the flow opening shown in FIG. 4A as the wafer surface is more fully immersed into the process solution and shaping members are moved away.

FIG. 4B illustrates the instant that the surface of the wafer is immersed into the process solution. As shown in FIG. 4B with dotted lines, as soon as the surface 114 is immersed into the process solution, the shaping members 103A and 103B are moved away from each other into the passive position to start the electrochemical process without interference from the shaping members.

Figure 5A:
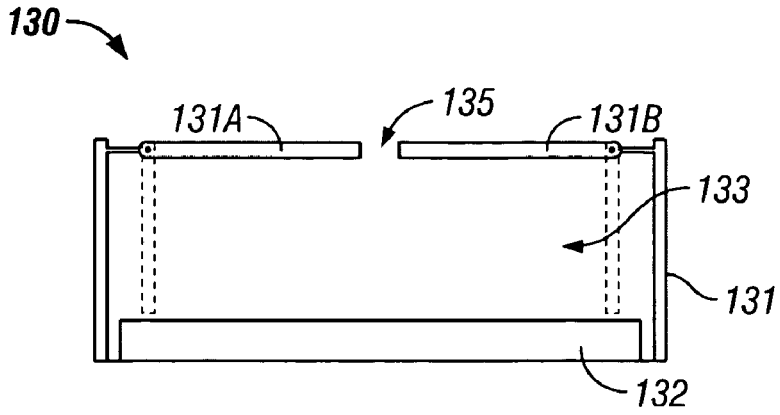
FIGS. 5A–5B illustrate various alternative embodiments of moving systems of the solution shaper of the present invention
Figure 5B:
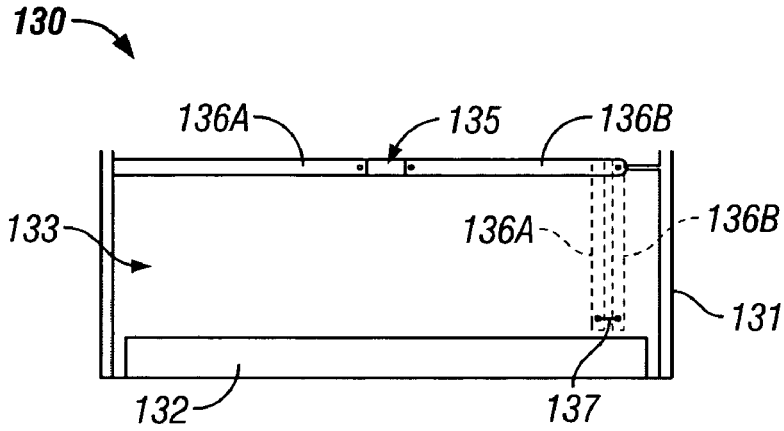

In the embodiments shown in FIGS. 2–4B, the shaping members of the solution shapers are moved laterally between the active and the passive positions. FIGS. 5A and 5B illustrate alternative embodiments to move the solution shapers. As shown in FIGS. 5A–5B, an electrochemical process system 130 comprises a process solution chamber 131 with an electrode 132 immersed in a process solution 133. In FIG. 5A, the shaping members 134A and 134B are attached to upper end of the chamber walls and are able to move between an active and passive positions. In the active position, the shaping members are near-laterally oriented and thereby form the high flow section or the flow opening 135 between them. When the bubble removal is over as described above, as shown with the dotted lines, the shaping members are aligned near-vertically and put the shaping members into a passive or stowed position to allow electrochemical process to begin or continue. Lateral and vertical positioning of the shaping members in the examples given are only exemplary. It should be understood that the positions of these members may be changed as long as active position provides the necessary localized solution flow and passive position moves the shaping members away into a location where they do not interfere with the processing.

In FIG. 5B, the shaping members 136A and 136B are movably connected with a joint section 137, which also includes the flow opening 135. The shaping member 136B is attached to the upper end of the solution chamber 130. During the bubble removal step, the members are put into an active or extended position, thereby forming the flow opening 135. When the bubble removal is over, as shown with the dotted lines, the shaping members are folded into a passive or stowed position.

Although in the previous embodiment, the shaping members of the solution shaper are described as rectangular plates, they may have many other shapes depending on the shape of the electrochemical processing chamber that delivers the process solution to the workpiece surface.

Figure 6:
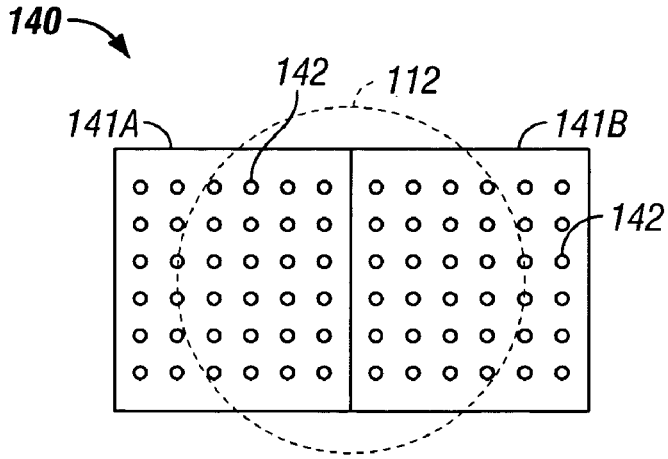
FIG. 6 illustrates an alternative embodiment of the solution shaper of the present invention having a plurality of openings to allow solution flow and uniform processing.

FIG. 6 exemplifies a solution shaper 140 with shaping plates 141A and 141B having openings 142 on it. Openings 142 are designed to shape the electric field as well as the solution flow to the workpiece surface and provide uniform deposition or removal. FIG. 6 shows the position of the shaping plates during the processing. Right before processing, however, the shaping plates may be partially opened as shown in FIG. 3A forming a gap or flow opening between them and allow process solution to preferentially flow towards the central region of the surface of the wafer 112, eliminating bubbles as described before. In this embodiment, after the bubble removal, the shaping members 141A and 141B are further moved towards each other to close the gap between them as shown in FIG. 6. Electrochemical process continues with the process solution flowing through the openings 142 of the solution shaper. At this stage, the solution shaper acts as shaping plate, which is exemplified in connection with FIG. 12. A shaping plate assists uniform deposit or removal of a conductive material during electrochemical processing of a semiconductor wafer by shaping the flow as well as the electric field arriving onto the wafer surface.

Figure 7A:
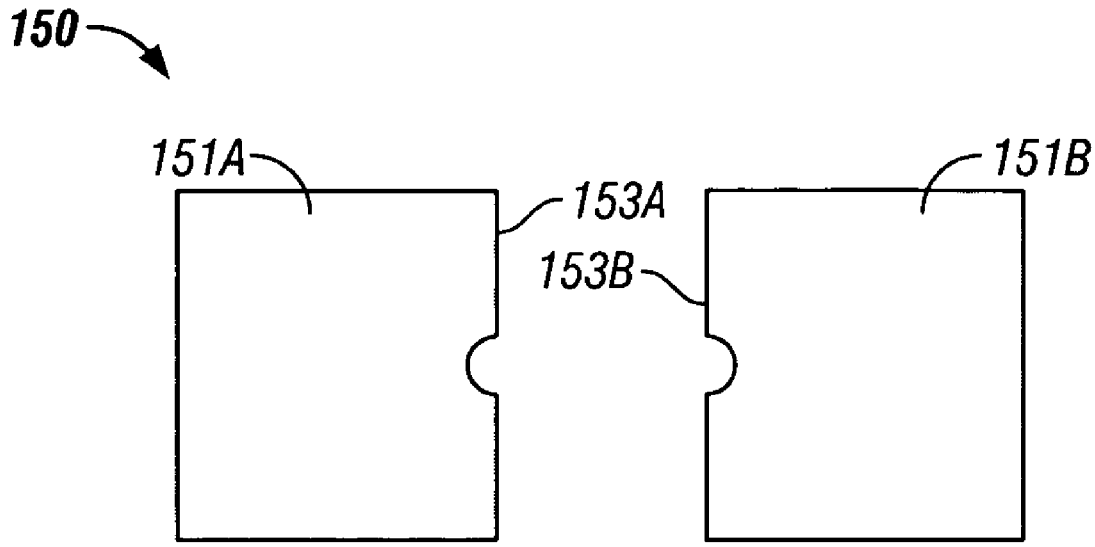
FIGS. 7A–7B illustrate an alternative embodiment of the solution shaper of the present invention.
Figure 7B:
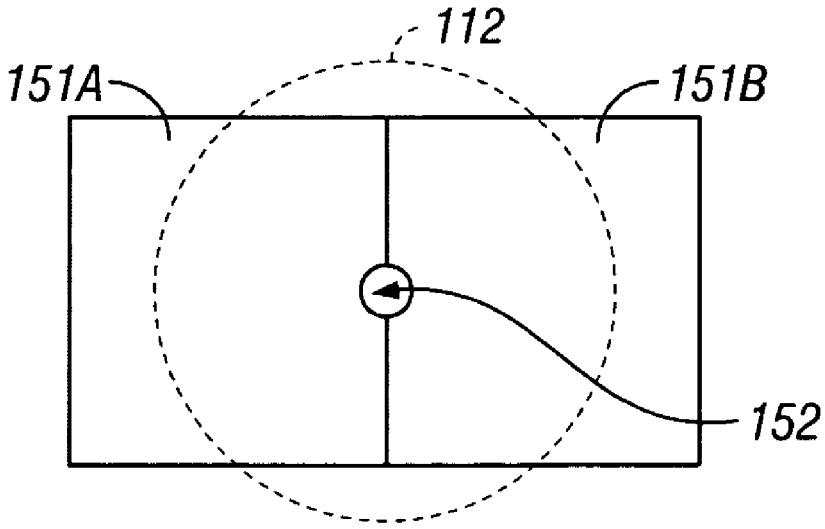

FIGS. 7A–11B show various embodiments of the solution shaper described above, which can be used with the system illustrated in FIG. 2. In all these embodiments, a flow of the process solution is directed towards the central region of the surface of the wafer during the bubble removal stage. However, in each embodiment, the nature of the solution flow is dictated by the characteristics of the solution shaper. As illustrated in FIGS. 7A and 7B, in top view, a solution shaper 150 includes shaping members 11A and 151B. In this embodiment, a flow opening 152 is formed between an edge 153A of the shaping member 151A and an edge 153B of shaping member 151B when the two edges are moved towards each other and engage. In this embodiment, the high flow section or the flow opening 152 is a circular opening to allow a process solution to flow through it towards the surface of wafer 112. FIG. 7A shows the shaping members in a passive position where an electrochemical process onto the surface of the wafer can be performed. FIG. 7B shows the shaping members in active position where the bubble elimination process can be performed on the wafer. When the shaping members are in active position, the flow opening 152 is aligned under the center of the wafer so that the solution flow can be directed to the center of the wafer. In this embodiment, the shaping members 151A and 151B are also moved in substantially the same plane so that the edges 153A and 153B meet when the shaping members are in active position.

Figure 8A:
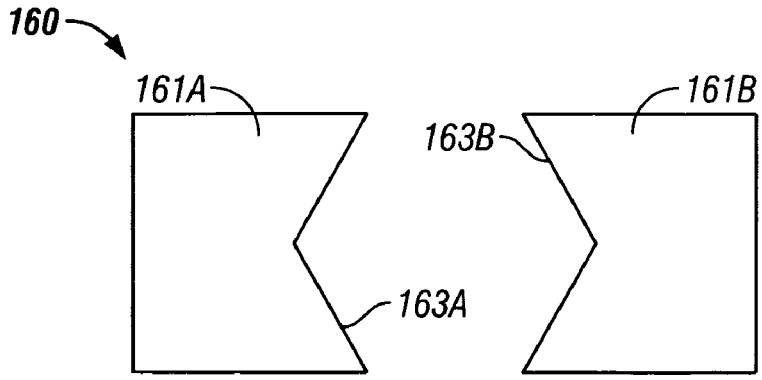
FIGS. 8A–8C illustrate another alternative embodiment of the solution shaper of the present invention.
Figure 8B:
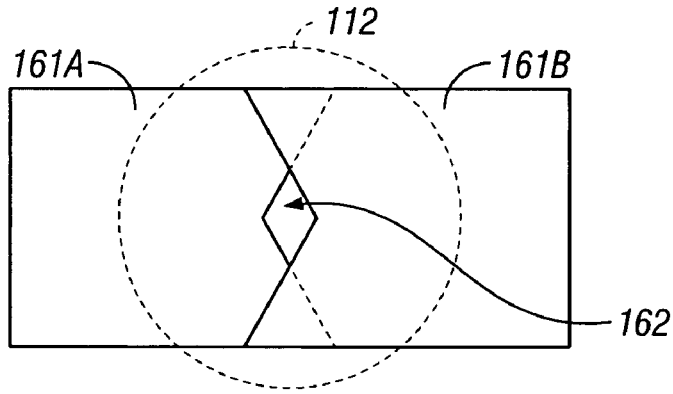
Figure 8C:
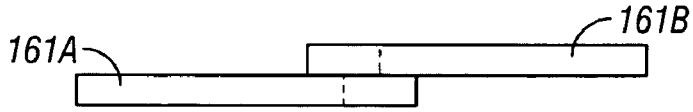

FIGS. 8A–8C illustrate another embodiment of a solution shaper 160, which includes shaping members 161A and 161B. In this embodiment, a high flow section or flow opening 162 is formed between an edge 163A of the shaping member 161A and an edge 163B of shaping member 161B. In this embodiment, the edges 163A and 163B are recessed edges, such as v-shaped edges. Referring to FIGS. 8B and 8C, when the edges are laterally moved towards each other and the shaping members are placed on top of each other they form the flow opening 162. In this embodiment, the shaping members are not in the same plane so that when they meet they slide on top of each other or they are juxtaposed. This way the size of the flow opening can be reduced or enlarged by moving the shaping members with respect to each other. FIG. 8A shows the shaping members in passive position where an electrochemical process can be performed on the surface of the wafer. It should be noted that the distance between the shaping members may be increased when they are in passive position. This is true in general for all the cases exemplified for example in FIGS. 4B, 7A and 9. FIGS. 8B and 8C show the shaping members 161A and 161B in active position where the bubble elimination process can be performed on the wafer, preferably at the beginning of the electrochemical process. When the shaping members are in active position, the flow opening 162 is preferably aligned under the center of the wafer so that the solution flow can be directed to the center of the wafer to eliminate bubbles. Then the shaping members can be returned to the passive position and a uniform electrochemical process may be carried out without the interference of the shaping members.

Figure 9:
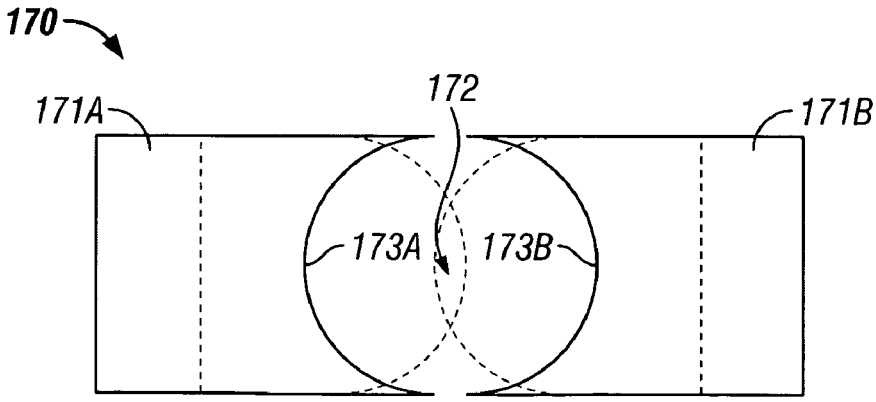
FIG. 9 illustrate an alternative embodiment of the solution shaper of the present invention.

FIG. 9 illustrates another embodiment of a solution shaper 170 includes shaping members 171A and 171B. In this embodiment, a high flow section or flow opening 172 is formed between an edge 173A of the shaping member 171A and an edge 173B of shaping member 171B. In this case the edges 173A and 173B are recessed edges as in the pervious embodiment but this time they are inwardly rounded. As shown in FIG. 9 with dotted lines, when the edges are laterally moved towards each other and the shaping members are placed on top of each other they form the flow opening 172. As can be seen from the discussion above there are many different shapes of shaping members that can be used for practicing the present invention and that the size of the flow opening can be reduced or enlarged by moving the shaping members with respect to each other.

Figure 10A:
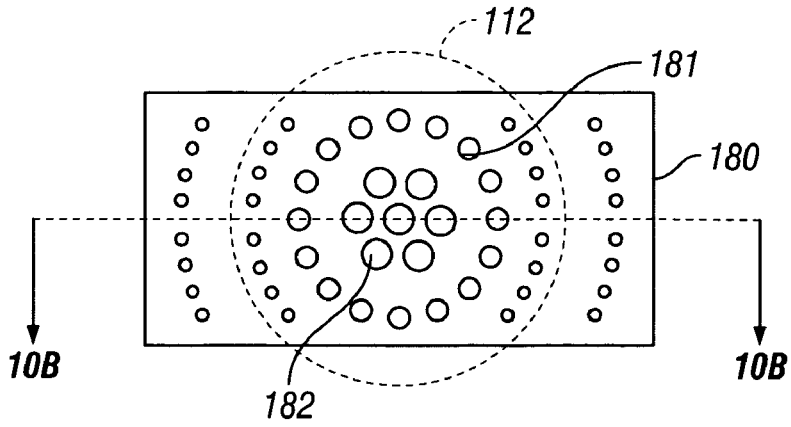
FIG. 10A illustrates a top view of a single piece solution shaper of the present invention having at least one solution flow opening and a plurality of openings to allow solution flow.
Figure 10B:
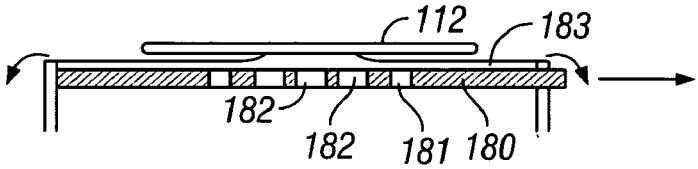
FIG. 10B illustrates a side view of the solution shaper shown in FIG. 10A.

FIGS. 10A and 10B illustrate an alternative solution shaper 180. In this embodiment, solution shaper 180 includes openings 181 having varying sizes. Openings allow a process solution 183 to flow through and wet the surface of the wafer 112. Openings placed at the center of the solution shaper 180 are larger than the rest of the openings, and large openings 182 function as flow opening when they are placed under the center of the wafer 112. Large openings 182 allow a solution flow higher than the rest of the openings and therefore the solution flow from the larger openings reach the center of the surface of the wafer 112 and prevent bubble formation. The solution shaper 180 may be a single piece plate. During bubble removal process, the solution shaper 180 is placed under the surface of the wafer 112 into active position. After the bubble removal, the solution shaper 180 is pulled away with a moving mechanism.

Figure 11A:
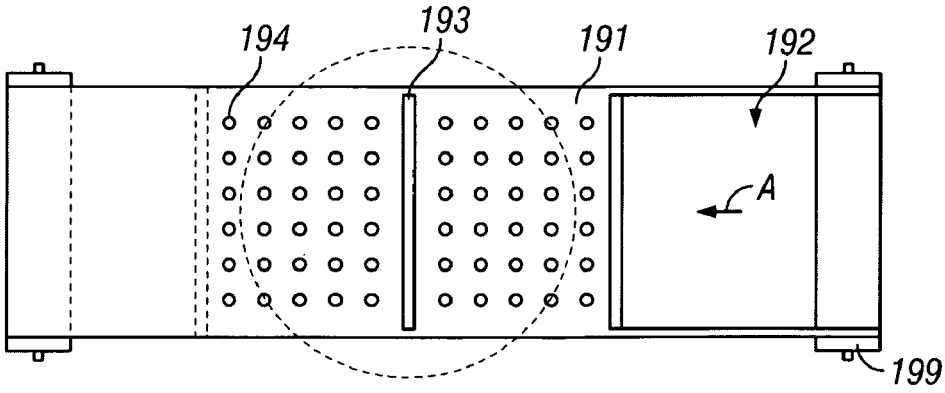
FIGS. 11A–11B illustrate an embodiment of a belt-type solution shaper of the present invention.
Figure 11B:
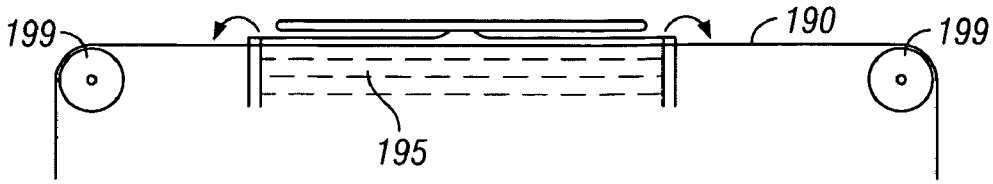

FIGS. 11A and 11B show a process belt 190 having solution shaper section 191 and a process opening 192. The process belt 190 is placed on top of a process chamber containing a process solution 195. The process opening 192 may be a large opening that allows electrochemical process to occur without interference, or alternately it may have specially designed openings to provide a substantially uniform electrochemical process to occur. The solution shaper section on the other hand has a different opening design to allow bubble removal, preferably right at the beginning or prior to the electrochemical processing. The solution shaper section has a flow opening 193 and may additionally have a plurality of smaller openings 194. In FIG. 11A, the solution shaper is a belt and the flow opening is a rectangular slit through the belt. The flow opening 193 can have any shape of geometry (such as circular, triangular etc) as long as it is placed under preferably the central region of the wafer surface for bubble removal. The belt solution shaper may be made of a chemically resistant polymer belt material and is supported and tensioned on rollers 199. For bubble removal, the belt is forwarded in the direction of arrow A to bring the solution shaper section 191 into active position. After the bubbles are removed, the belt 190 is forwarded to bring the process opening onto the chamber to allow electrochemical process onto the wafer.

Figure 12:
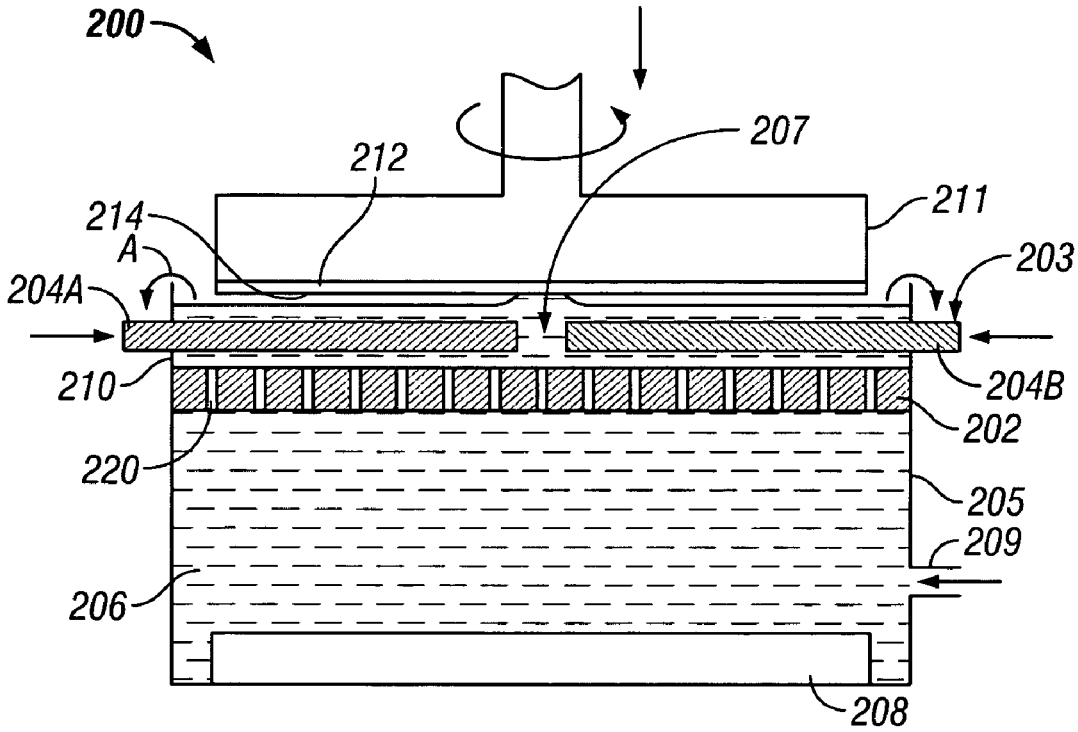
FIG. 12 illustrates an electrochemical mechanical processing system using a solution shaper over a shaping plate.

FIG. 12 illustrates another exemplary ECD system 200 of the present invention, which uses a shaping plate 202 placed under a solution shaper 203. In this embodiment, except the solution shaper, the rest of the components of the system 100 are similar to the system 100 described above. The solution shaper 203 may have a first shaping member 204A and a second shaping member 204B. In this embodiment, the gas bubble removal using the shaping members is performed the same way it is used in the previous embodiment. However for the sake of clarity, in the description of this embodiment, different reference numerals are used. The system 200 includes a chamber 205 containing a process solution 206 and an electrode 208 immersed into the solution 206. The process solution 206 can be delivered to the chamber 205 through a solution inlet 209. The solution 206 leaves the chamber from an upper end 210 of the chamber as depicted by arrow A. A carrier head 211 holds a wafer 212 and exposes a surface 214 of the wafer 212 to the process solution. The carrier head 211 can be rotated and moved in z-direction.

Referring to FIG. 12, during the process, as the wafer is moved towards the process solution 206, the shaping members 204A and 204B are moved into the active position to form a flow 207 of the process solution toward the central area of the wafer surface. The solution flow removes the gas bubbles and the shaping plates are moved back to passive position as the wafer surface is immersed into the solution and moved toward the shaping plate 202. The surface 214 of the wafer is disposed in proximity of the shaping plate 202. As the process solution is flowed through openings 220 of the shaping plate, openings 220 in the shaping plate stabilize the process solution and shape the electric field to provide uniform processing on the wafer surface. During the following electroplating, the shaping plate 202 may contact the surface of the wafer to mechanically sweep the surface to obtain a planar depositing film as in some techniques aiming to obtain relatively flat copper topography on patterned wafer surfaces. In this case, the top of the shaping plate may include a pad material to mechanically sweep the surface during the process. An exemplary technique that can reduce, or totally eliminate, copper surface topography for all feature sizes is the Electrochemical Mechanical Processing (ECMPR). This technique has the ability to provide thin layers of planar conductive material on the wafer surfaces, or even provide a wafer surface with no or little excess conductive material. This way, a planarization process step using CMP can be minimized or even eliminated. The term "Electrochemical Mechanical Processing (ECMPR)" is used to include both Electrochemical Mechanical Deposition (ECMD) processes as well as Electrochemical Mechanical Etching (ECME), which may also be called Electrochemical Mechanical Polishing (ECMP). It should be noted that in general both ECMD and ECME processes are referred to as electrochemical mechanical processing (ECMPR) since both involve electrochemical processes and mechanical action on the wafer surface.

Descriptions of various ECMPR approaches and apparatus, can be found in the following patents, published applications and pending applications, all commonly owned by the assignee of the present invention: U.S. Pat. No. 6,126,992 entitled "Method and Apparatus for Electrochemical Mechanical Deposition," U.S. application Ser. No. 09/740,701 entitled "Plating Method and Apparatus that Creates a Differential Between Additive Disposed on a Top Surface and a Cavity Surface of a Workpiece Using an External Influence," filed on Dec. 18, 2001 and published as U.S. Patent Application on Feb. 21, 2002 with patent application No. 20020020628, and U.S. Application filed on Sep. 20, 2001 with Ser. No. 09/961,193 entitled "Plating Method and Apparatus for Controlling Deposition on Predetermined Portions of a Workpiece". U.S. Application with Ser. No. 09/960,236 filed on Sep. 20, 2001, entitled "Mask Plate Design." U.S. application Ser. No. 10/155,828 filed on May 23, 2002 entitled "Low Force Electrochemical Mechanical Processing Method and Apparatus."

Although the invention has been described with examples of electrochemical deposition systems. As indicated above, it is applicable to many electrochemical processes. Specifically the method and apparatus described in this manuscript are applicable to electrochemical (such as electrochemical polishing or etching) and electrochemical mechanical (such as electrochemical mechanical polishing or etching) removal techniques as well as chemical (such as chemical etching) removal and chemical deposition (electroless deposition) techniques. All these techniques use process solutions and initial contact of the workpiece with the process is important. Elimination of bubbles that may form on the workpiece surface during especially the early stages of these processes is very important for good process results. The present invention can be used to achieve this.

Although various preferred embodiments and the best mode have been described in detail above, those skilled in the art will readily appreciate that many modifications of the advantages of this invention

I claim:

1. A system for avoiding formation of gas bubbles on a selected region of a surface of a workpiece in a process chamber as the workpiece surface is brought in contact with a process solution for an electrochemical process using the process solution, comprising:

a workpiece carrier to hold and move the workpiece; and a solution shaper having at least one high flow section to direct a process solution flow towards the selected region of the workpiece surface for a predetermined time, the solution shaper being adapted to move to bring the high flow section under the selected region of the workpiece surface, the solution shaper comprising a first shaping member and a second shaping member, wherein the shaping members are plates that are moved towards each other to form the high flow section under the selected region of the workpiece.

2. The system of claim 1, wherein the shaping members are moved away from each other after the predetermined time to remove the high flow section and to stop directing the process solution flow.

3. The system of claim 1, wherein the high flow section is comprised of at least one flow opening.

4. The system of claim 3, wherein the shaping members include one or more openings that allow the process solution to flow towards the surface of the workpiece.

5. The system of claim 4, wherein the openings are smaller than the at least one flow opening.

6. The system of claim 1, wherein the high flow section is comprised of a slit.

7. A system for avoiding formation of gas bubbles on a selected region of a surface of a workpiece in a process chamber as the workpiece surface is brought in contact with a process solution for an electrochemical process using the process solution, comprising:

a workpiece carrier to hold and move the workpiece; and a solution shaper having at least one high flow section to direct a process solution flow towards the selected region of the workpiece surface for a predetermined time, wherein the solution shaper is adapted to move to bring the high flow section under the selected region of the workpiece surface, and the solution shaper is a removable plate which is used during bubble removal and is removed after bubble removal.

8. The system of claim 7, wherein the removable plate includes a plurality of flow openings in differing sizes, wherein large openings are grouped to form the high flow section.

9. The system of claim 7, wherein the selected region is a central region of the surface of the workpiece.

10. The system of claim 7, wherein the workpiece is a semiconductor wafer.

* * * * *

UNITED STATES PATENT AND TRADEMARK OFFICE

CERTIFICATE OF CORRECTION

PATENT NO. : 7,045,040 B2
APPLICATION NO. : 10/692952
DATED : May 16, 2006
INVENTOR(S) : Basol M. Bulent It is certified that error appears in the above-identified patent and that said Letters Patent is hereby corrected as shown below:

In Col. 6, line 33, Delete "11A" and insert --151A--, therefor.

Signed and Sealed this

Twenty-eighth Day of August, 2007

JON W. DUDAS
*Director of the United States Patent and Trademark Office*